US012742606B1

(12) United States Patent
Bader

(10) Patent No.: US 12,742,606 B1
(45) Date of Patent: Sep. 22, 2026

(54) FIREARM NOISE SUPPRESSOR

(71) Applicant: Wade Bader, Tampa, FL (US)

(72) Inventor: Wade Bader, Tampa, FL (US)

( * ) Notice: Subject to any disclaimer, the term of this patent is extended or adjusted under 35 U.S.C. 154(b) by 0 days.

(21) Appl. No.: 18/831,594

(22) Filed: May 22, 2025

Related U.S. Application Data

(60) Provisional application No. 63/731,668, filed on May 24, 2024.

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/32; F41A 21/325
See application file for complete search history.

(56) References Cited

U.S. PATENT DOCUMENTS

| | | | | |
|---|---|---|---|---|
| 1,111,202 | A * | 9/1914 | Westfall | F41A 21/30 89/14.4 |
| 5,679,916 | A * | 10/1997 | Weichert | F41A 21/30 181/232 |
| 6,374,718 | B1 * | 4/2002 | Rescigno | F41A 21/30 89/14.4 |
| 7,073,426 | B1 * | 7/2006 | White | F41A 21/30 89/14.4 |
| 10,126,084 | B1 * | 11/2018 | Oglesby | F41A 21/30 |
| 2007/0107590 | A1 * | 5/2007 | Silvers | F41A 21/34 89/14.4 |
| 2014/0224575 | A1 * | 8/2014 | Latka | F41A 21/30 156/60 |
| 2014/0318887 | A1 * | 10/2014 | Latka | F41A 21/30 181/296 |
| 2017/0350669 | A1 * | 12/2017 | Latka | F41A 21/30 |
| 2022/0260332 | A1 * | 8/2022 | Grob | F41A 21/30 |
| 2024/0068763 | A1 * | 2/2024 | Piche | F41A 21/30 |
| 2025/0093120 | A1 * | 3/2025 | Grob | F41A 21/30 |

FOREIGN PATENT DOCUMENTS

| | | | | |
|---|---|---|---|---|
| WO | WO-2018090058 | A1 * | 5/2018 | F41A 21/30 |
| WO | WO-2022115870 | A2 * | 6/2022 | F41A 21/30 |
| WO | WO-2023137270 | A2 * | 7/2023 | F41A 21/30 |

* cited by examiner

*Primary Examiner* — Jonathan C Weber
(74) *Attorney, Agent, or Firm* — Arthur W. Fisher, III

(57) ABSTRACT

A sound suppressor for a firearm comprising a plurality of axially aligned baffles disposed within an outer sheath having a proximal entry opening and a distal exit opening, each axially aligned baffle comprises a proximal metal gas diffuser having a passage formed therethrough to cooperatively form an interrupted exhaust gas channel to direct the exhaust gas generated when the firearm is fired as the exhaust gas migrates from the proximal entry opening to the distal exit opening through the interrupted exhaust gas channel and a distal carbon fiber shell partially embedded in a corresponding proximal metal gas diffuser and including a central cavity aligned with the corresponding proximal metal gas diffuser such that the proximal metal gas diffuser is disposed in the central cavity of the adjacent distal carbon fiber shell to cooperatively form a gas expansion chamber to dissipate a portion of the exhaust gas as the exhaust gas migrates from the proximal entry opening to the distal end opening of the sound suppressor.

9 Claims, 4 Drawing Sheets

FIREARM NOISE SUPPRESSOR

BACKGROUND OF THE INVENTION

Field of the Invention

A sound suppressor for a firearm comprising a plurality axially aligned baffles disposed within an outer sheath or shell.

Description of the Prior Art

Examples of firearm noise suppressors are found in abundance. The following examples are believed representative of the prior art most similar to the invention defined and described herein.

U.S. Pat. No. 10,591,238 describes a firearm noise suppressor comprising a plurality of axially aligned cups or hollow members constructed of fibrous material impregnated with an epoxy resin cooperatively forming a plurality of chambers encased in an outer sleeve and a method for producing the firearm noise suppressor comprising the steps of individually forming each of the cups or hollow members from a fibrous material having a centrally disposed aperture formed therethrough, and adjacent cups or hollow members cooperatively form an expansion chamber therebetween.

US 2017/0299313 shows a suppressor for reducing muzzle blast and noise of firearms comprising baffle tube including a stack of baffle modules removably coupled to one another, an optional blast baffle and end cap, and an end cap insert. The stack of baffle modules are independently supported from both bullet entry and exit ends of the tube with the stack under tension and the tube under compression. Two or more tubes of can be joined with one another at ends having corresponding sealing flanges which also can center the tubes relative to one another. A blast baffle separates pressurized gas into a first pathway through the baffle stack and a second pathway between the baffle modules and the baffle tube. The baffle tube and/or an expansion chamber tube can include a rearward end cap that is removable and replaceable with an over the barrel expansion tube.

US 2018/0306544 discloses a threaded coupler to connect two portions of a firearm sound suppressor housing together. The threaded coupler includes a sound suppressing baffle. The threaded coupler and integrated baffle provide additional sound suppression compared to sound suppressors with other types of connectors between housing portions.

U.S. Pat. No. 5,679,916 teaches a silencer for a firearm comprising a composite outer wall, an end piece which forms a silencer muzzle and in which is located an exit opening, an attachment piece which is attached to said end piece, and a middle piece which is positioned between the attachment piece and the end piece. The middle piece comprises a selected number of axially aligned chambers. Each of the chambers has a firing opening and an outside wall. Each of the chambers is attached in a modular fashion directly to an adjoining one of the selected number of chambers. The outside walls of the selected number of chambers form the composite silencer wall.

U.S. Pat. No. 9,476,661 relates to a suppressor for reducing muzzle blasts in firearms includes a mounting apparatus with a rear end designed to mate with a firearm barrel. A plurality of baffles each including aligning and joining features mating one baffle with the blast cap and the remaining baffles to each other. Each baffle includes a plate having gas ports therethrough positioned within a cylindrically shaped sidewall. The mounting apparatus, the blast cap, the plurality of baffles, and the end cap are affixed together using the aligning and joining features to form the suppressor.

US 2012/0152093 discloses an assembly for a firearm including a sleeve connected to the receiver or receiver end of the barrel. The sleeve extends beyond the discharge end of the barrel and includes inwardly extending projections abutting or juxtaposed to a peripheral section of the discharge end of the barrel. A noise suppressor threads onto the sleeve. Some of the propellant gases are redirected and cooled by the noise suppressor in a conventional manner. Some of the propellant gases are redirected into an annulus between the barrel and sleeve where they are cooled and some of their volume is reduced thereby increasing the efficiency of the noise suppressor.

U.S. Pat. No. 7,325,474 describes a silencer comprises a casing cylinder and a segment member housed in the casing cylinder to constitute a sound reducing means. The silencer further comprises a segment member fastening means for fastening the segment member to the casing cylinder, a gas inlet-side lid plate with a punched hole, which closes an opening at one end of the casing cylinder, and a gas outlet-side lid plate with a punched hole, which closes an opening at the other end of the casing cylinder. At least either one of the gas inlet-side lid plates or the gas outlet-side lid plate is adapted to be detachable from the casing cylinder.

US 2016/0209152 shows a sound suppressor for a firearm including a baffle; a spacer abutted to the baffle; and a circumferential laser weld joining the baffle and the spacer. The sound suppressor may include a plurality of baffles; a plurality of spacers; a substantially tubular housing surrounding the baffles and the spacers wherein the housing and the spacers define an annular volume surrounding the spacers. An aperture is adapted to direct combustion gases in a radial direction from within the spacer into the annular volume to reduce ejection port flash of the firearm.

U.S. Pat. No. 8,973,481 discloses a firearm sound suppressor comprising a housing, a baffle, and an inner sleeve configured to be disposed within the housing and to substantially surround the baffle. The inner sleeve includes a sidewall adapted to slide against the housing to permit the inner sleeve with the baffle to be selectively inserted into and removed from the housing without the baffle contacting the housing. A longitudinal split extends through the sidewall and between the front and rear ends of the inner sleeve to permit the sidewall to flex to permit removal of the baffle from the inner sleeve.

U.S. Pat. No. 6,374,718 relates to a silencer for a shotgun firearm comprising a metal body tube, a frontend closure having a projectile exit guide, and a rear end closure having a barrel mounting element. A plurality of conical baffles with metal guide bushings are serially positioned in the body and arranged coaxially with the bore of the shotgun barrel. The guides are spaced apart a distance less than the axial length of the shot cup of the shotgun projectile. An expansion chamber is provided in the body rearwardly of the muzzle where the muzzle gasses are initially discharged into the body.

U.S. Pat. No. 7,749,423 shows a method of producing a device comprising impregnating a fibrous carbon graphite fabric with epoxy resin and allowing the epoxy resin to harden in the fibrous carbon graphite fabric.

Additional examples of the prior art are found in U.S. Pat. Nos. 3,385,164; 7,789,008; 7,856,914; 8,096,222; 8,991,550; 9,366,495; 9,482,484; 9,677,839; 9,714,805; 9,746,267; US 2012/0272818; US 2016/0018178 and US 2016/0187093.

While some of the prior art may contain some similarities relating to the present invention, none of them teach, suggested or include all of the advantages and unique features of the invention disclosed hereafter.

SUMMARY OF THE INVENTION

The present invention relates to a sound suppressor including a proximal end and a distal end to reduce the report of a firearm when the firearm is discharged. In particular, a plurality of axially aligned baffles are encased in a substantially cylindrical sheath extending from the proximal end to the distal end of the sound suppressor.

Each baffle includes a proximal metal gas diffuser comprising a hollow conical member and a distal carbon fiber shell comprising an inner hollow cone and an outer skirt that together form a cavity. The proximal metal gas diffuser extends into and is disposed in the cavity of the adjacent baffle to form a corresponding gas expansion chamber as described hereinafter.

The distance or linear dimension from the distal periphery of the distal carbon fiber shell to the distal end of the corresponding inner hollow cone measured in along the center line axis of the sound suppressor is greater than the distance or linear dimension from the distal periphery of the inner hollow cone to the proximal tip of the hollow conical member of the proximal metal gas diffuser such that when the sound suppressor is assembled that with the exception of the baffle adjacent the proximal end of the sound suppressor, the distal end of the hollow conical member of the proximal metal gas diffuser is disposed in spaced relationship relative to the proximal end or periphery of the hollow conical member of the next adjacent proximal metal gas diffuser forming the gas expansion chamber between the outer skirt of the distal carbon fiber shell and the inner hollow cone of the adjacent proximal metal gas diffuser.

This summary is not intended to describe essential features of the claimed subject matter nor is it intended to limit the scope of the claimed 5 subject matter. To the contrary, this summary merely outlines various concepts and features that are developed in the Detailed Description.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

Figure 1:
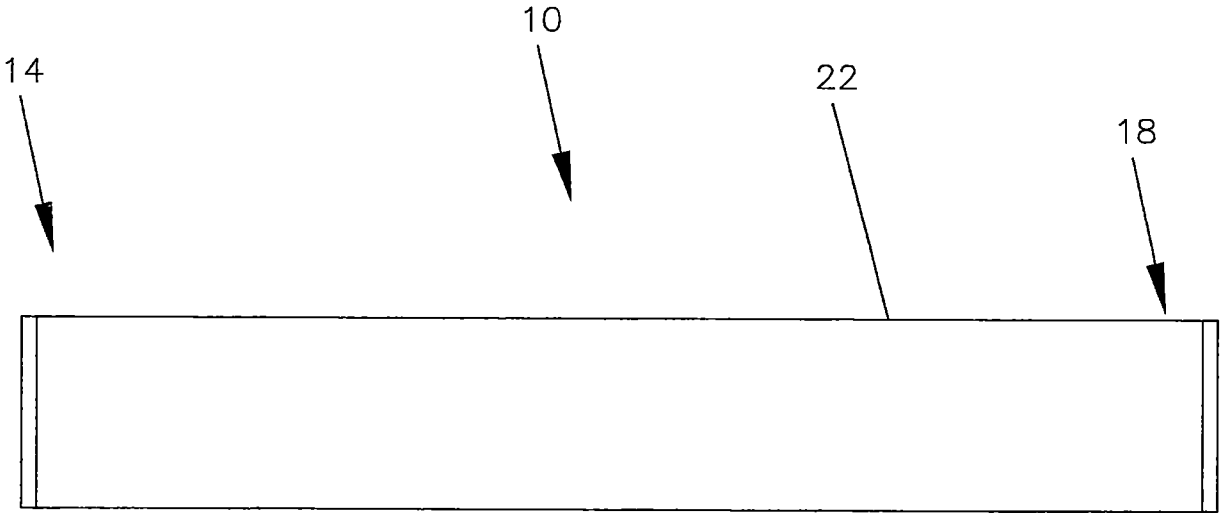
FIG. 1 is an exterior view of the sound suppressor of the present invention.
Figure 2:
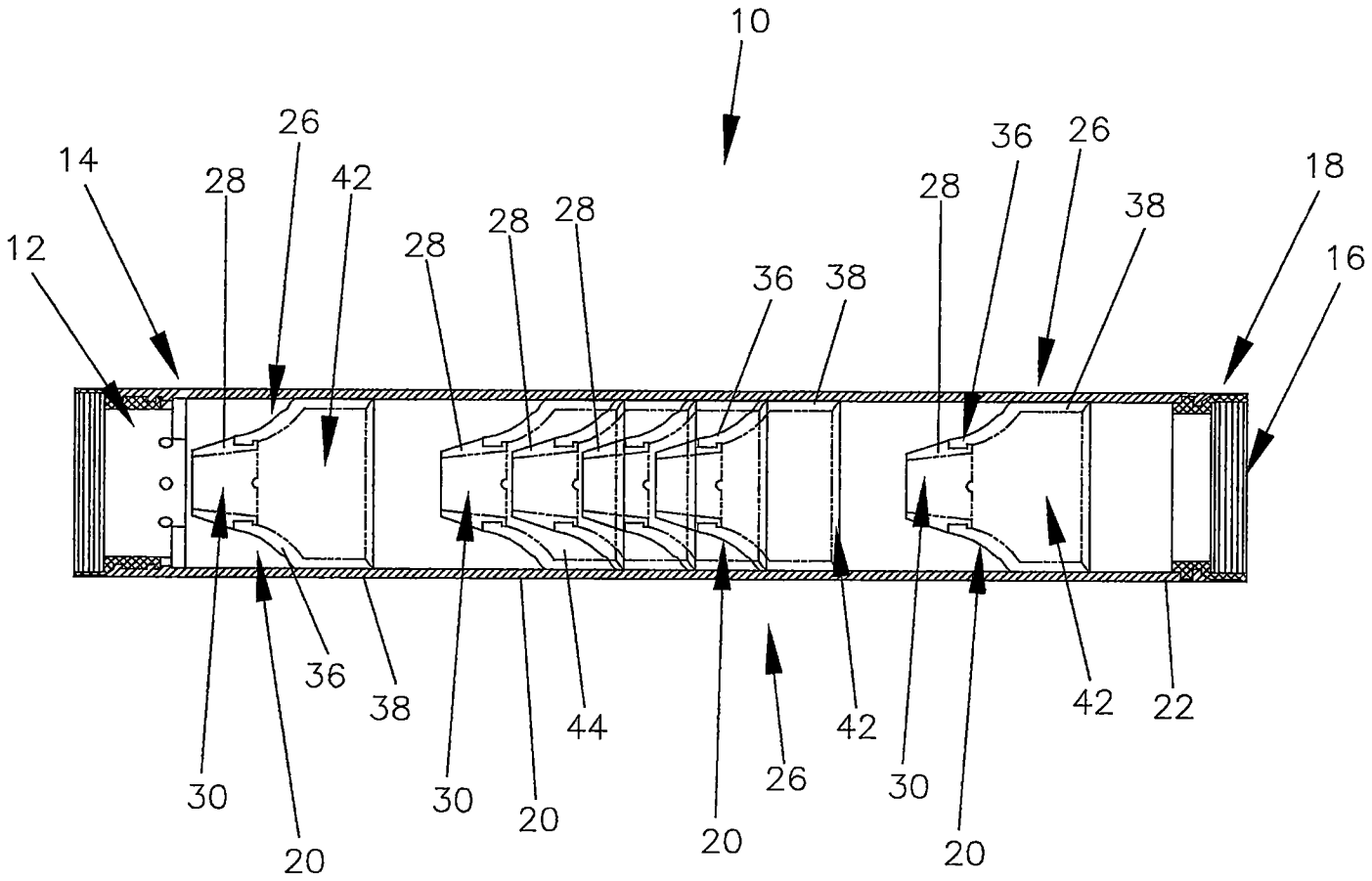
FIG. 2 is a cross-sectional view of the sound suppressor of the present invention.

As shown in FIGS. 1 and 2, the present invention relates to a sound suppressor generally indicated as 10 including a proximal entry opening 12 formed in the proximal end 14 thereof and a distal exit opening 16 formed in the distal end 18 thereof to reduce the report of a firearm (not shown) when the firearm is discharged.

As best shown in FIG. 2, a plurality of axially aligned baffles generally indicated as 20 are encased in an elongated substantially cylindrical sheath 22 extending from the proximal end 14 to the distal end 18 of the sound suppressor 10.

Figure 3:
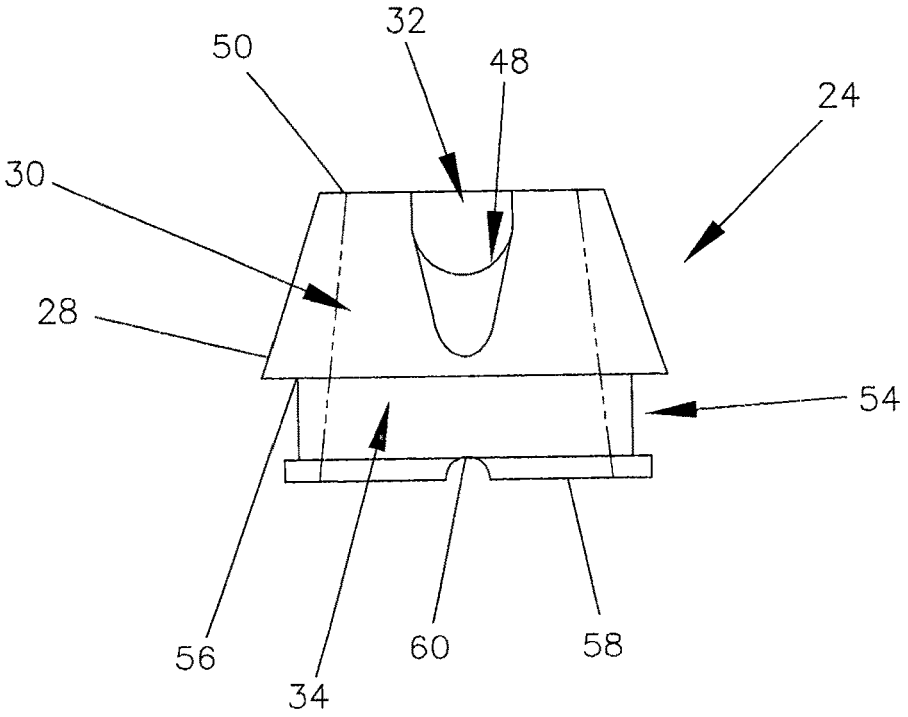
FIG. 3 is an exploded view of a baffle of the present invention.
Figure 3:
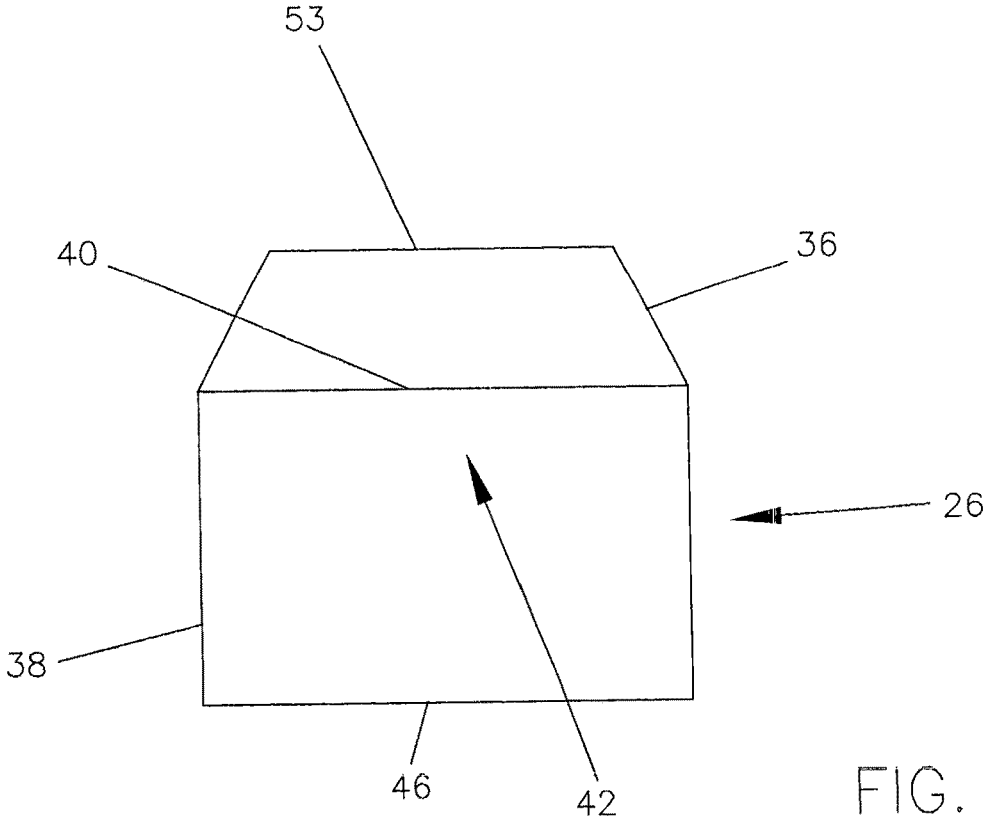
Figure 4:
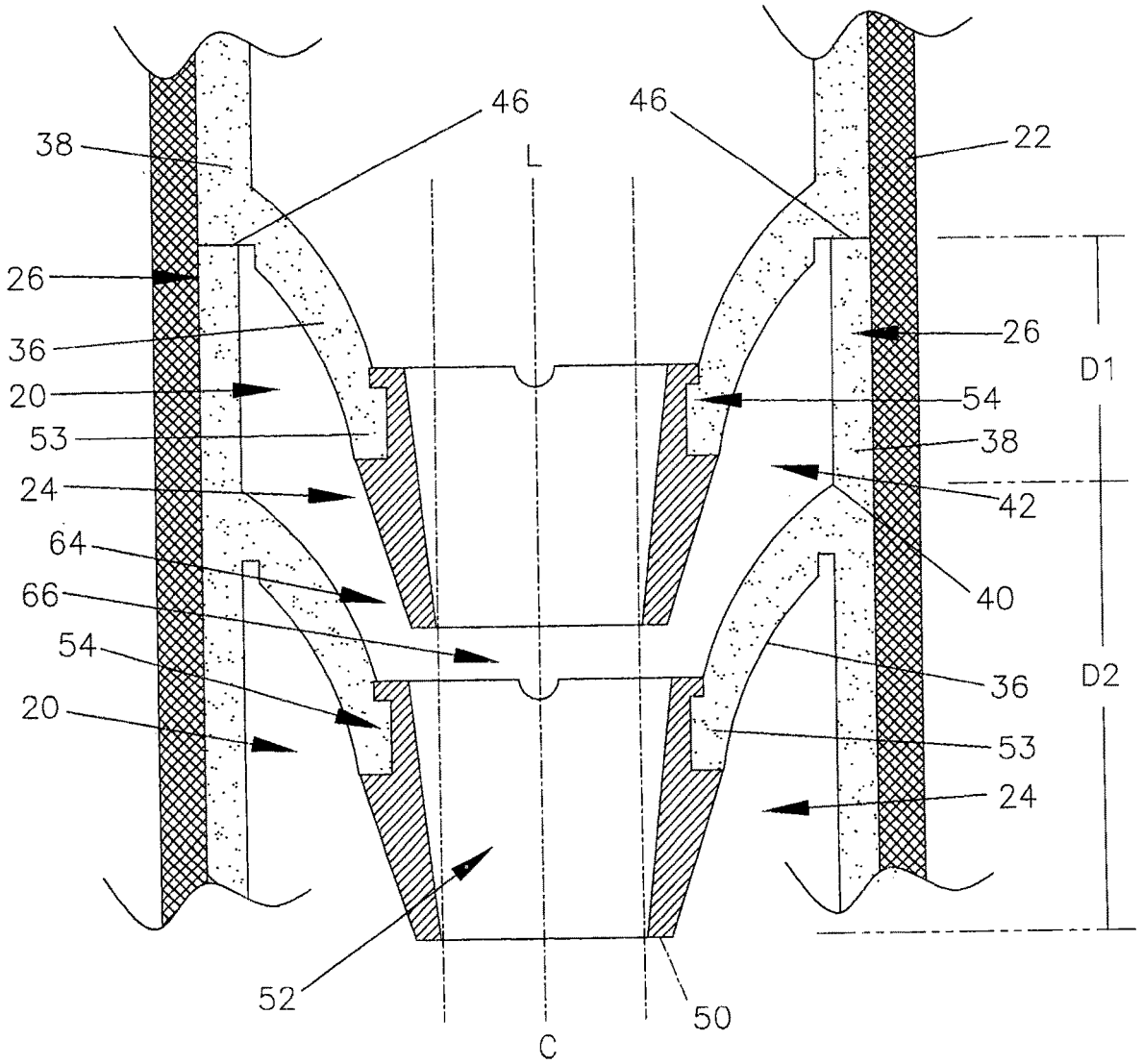
FIG. 4 is an enlarged view of a cross-section of a series of baffles of the present invention.

As shown in FIGS. 2 through 4, each baffle 20 comprises a proximal metal gas diffuser generally indicated as 24 and a distal carbon fiber shell generally indicated as 26. Each proximal metal gas diffuser 24 comprises a frustrum conical member 28 having a substantially funnel-shaped passageway 30 formed therethrough expanding or enlarging from a proximal entry orifice 32 to an distal exit orifice 34. Each distal carbon fiber shell 26 comprises an inner hollow truncated cone 36 and an outer substantially cylindrical skirt 38 extending outwardly from a distal peripheral base 40 of the inner hollow truncated cone 36 that together form a central cavity 42.

As shown in FIG. 2 with the exception of the proximal baffle 20, the proximal metal gas diffuser 24 extends into and is disposed in the central cavity 42 of the adjacent baffle 20 to form a corresponding gas expansion chamber 44 as described hereinafter.

As shown in FIGS. 2 and 3, the diameter of the distal peripheral base 40 of each inner hollow truncated cone 36 is equal to or less than the diameter of the distal end or base 46 of the outer substantially cylindrical skirt 38 of the distal carbon fiber shell 26 such that the distal peripheral base 40 of the inner hollow truncated cone 36 of each distal carbon fiber shell 26 engages the distal end or base 46 of the outer substantially cylindrical skirt 38 of each distal carbon fiber shell 26 of the adjacent baffle 20 as shown in FIG. 2 with the exception of the baffle 20 adjacent the distal end 18 of the sound suppressor 10.

As shown in FIG. 3, at least one exhaust gas notch 48 is formed in the proximal periphery or tip 50 of the frustrum conical member 28 of the proximal metal gas diffuser 24 to allow exhaust gas to escape into the corresponding gas expansion chamber 44 as the exhaust gas migrates through an interrupted exhaust gas channel 52 cooperatively formed by the funnel-shaped passageways 30 of the axially aligned baffles 20 (FIG. 2).

As best shown in FIGS. 3 and 4, the inner or proximal periphery 53 of the inner truncated cone 36 of each distal carbon fiber shell 26 is embedded in an annular groove 54 formed by the lower periphery or base 56 of the proximal frustrum conical member 28 of the corresponding proximal metal gas diffuser 24 and a retainer or disk 58.

As shown in FIG. 3, at least one securing notch or indentation 60 is formed in the retainer or disk 58 to prevent rotation of each distal carbon fiber shell 26 relative to the corresponding proximal metal gas diffuser 24 when the inner or proximal periphery 53 of the inner hollow truncated cone 36 of the distal carbon fiber shell 26 is embedded in the annular groove 54 of the proximal metal gas diffuser 24.

As shown in FIG. 4, the distance or linear dimension D1 from the distal periphery or base 46 of the outer substantially cylindrical skirt 38 of each distal carbon fiber shell 26 to the distal periphery or base 40 of the corresponding inner hollow truncated cone 36 measured in along the center line axis CL of the sound suppressor 10 is less than the distance or linear dimension D2 from the distal periphery base 40 of the inner hollow truncated cone 36 to the proximal periphery or tip 50 of the frustrum conical member 28 of the proximal metal gas diffuser 24. As a result, an annular space or passage 64 is formed between the proximal end portion of each frustrum conical member 28 of the proximal metal gas diffuser 24 and the inner truncated cone 26 of the adjacent distal carbon fiber shell 26 open to the corresponding exhaust gas chamber 44. In addition, a gap 66 is formed between the funnel-shaped passageways 30 of adjacent proximal metal gas diffusers 24 to form the interrupted exhaust gas channel 52.

As shown in FIG. 2, when the sound suppressor 10 is assembled that with the exception of the proximal baffle 20 adjacent the proximal entry opening 12 of the elongated substantially cylindrical sheath 18, the distal exit orifice 34 of the frustrum conical member 28 of each proximal metal gas diffuser 24 is disposed adjacent and in spaced relationship relative to the inner or proximal periphery 46 of the inner truncated cone 36 of the next adjacent the distal carbon fiber shell 26 to form the gas expansion chamber 44 between the distal carbon fiber distal shell 26, and the proximal metal frustrum conical member 28 and inner hollow truncated cone 36.

The diameter of the distal exit orifice 34 of each frustrum conical member 28 is substantially equal to or greater than the diameter of the proximal metal frustrum conical member 28 such that the proximal metal frustrum conical member 28 shields or shrouds the corresponding inner hollow truncated cone 36 by deflecting solid particles suspended in the exhaust gas flowing through the distal exit orifice 34 from the adjacent upstream metal proximal frustrum conical member 28 of the proximal metal gas diffuser 24.

In short, the sound suppressor 10 comprises the plurality of axially aligned baffles 20 disposed within an outer sheath 22 having a proximal entry opening 12 and a distal exit opening 16 wherein each axially aligned baffle 20 comprises the proximal metal gas diffuser 24 having the substantially funnel-shaped passageway 30 formed therethrough to cooperatively form an interrupted exhaust gas channel 52 to direct the exhaust gas when the firearm is fired from the proximal entry opening 12 to the distal exit opening 16. A distal carbon fiber shell 26 is partially embedded in the corresponding proximal metal gas diffuser 24 including a central cavity 42 aligned with the corresponding proximal metal gas diffuser 24 such that the proximal metal gas diffuser 24 is disposed in the central cavity 42 of the adjacent distal carbon fiber shell 26 cooperatively form the gas expansion chamber 44 to dissipate a portion of the exhaust gas as the exhaust gas migrates through the interrupted exhaust gas channel 50 of the sound suppressor.

The methods for producing the individual baffles 20 and the sound suppressor 10 are the same or similar to the methods disclosed and described in U.S. Pat. No. 10,591, 238.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

In describing the invention, certain terms are used for brevity, clarity, and understanding. No unnecessary limitations should be inferred beyond the requirement of the prior art because such terms are used for descriptive purposes and are intended to be broadly construed. The different structural and functional elements, apparatuses, devices, compositions, and methods described herein may be used alone or in combination with other structural and functional elements, apparatuses, devices, compositions, systems and methods. It is to be expected that various equivalents, alternatives and modifications are possible within the scope of this detailed description.

What is claimed is:

1. A sound suppressor for a firearm comprising a plurality of axially aligned baffles disposed within an outer sheath having a proximal entry opening and a distal exit opening, each said axially aligned baffle comprises a proximal metal gas diffuser including a frustrum conical member having a retainer or disk with a periphery formed on a distal end thereof to form an annular groove and having a passage formed therethrough to cooperatively form an interrupted exhaust gas channel to direct the exhaust gas generated when the firearm is fired as the exhaust gas migrates from said proximal entry opening to said distal exit opening through said interrupted exhaust gas channel and a distal carbon fiber shell including a truncated cone having a proximal periphery and including a central cavity aligned with said corresponding proximal metal gas diffuser such that said proximal metal gas diffuser is disposed in said central cavity of said adjacent distal carbon fiber shell to cooperatively form a gas expansion chamber to dissipate a portion of the exhaust gas as the exhaust gas expansion chamber to dissipate a portion of the exhaust gas as the exhaust gas migrates from said proximal entry opening to said distal end opening of the sound suppressor, said proximal periphery and adjacent portion of said truncated cone being partially embedded in said annular groove of a corresponding proximal metal gas diffuser and said periphery of said retainer or disk of said frustrum conical member of said proximal metal gas diffuser being embedded in adjacent portion of said corresponding truncated cone od said distal carbon fiber shell.

2. The sound suppressor of claim 1 wherein each said proximal metal gas diffuser comprises a frustrum conical member having a substantially funnel shaped passageway formed therethrough expanding or enlarging from a proximal entry orifice to a distal exit orifice.

3. The sound suppressor of claim 1 wherein with the exception of the proximal baffle, each said proximal metal gas diffuser extends into and is disposed in said central cavity of the adjacent baffle to form a corresponding gas expansion chamber.

4. The sound suppressor of claim 1 wherein a diameter of the distal peripheral base of each said inner hollow truncated cone is equal to or less than the diameter of the distal end or base of the outer substantially cylindrical skirt of the distal carbon fiber shell such that the distal peripheral base of the inner hollow truncated cone of each distal peripheral base of the inner hollow truncated cone of each distal carbon fiber shell engages the distal end or base of the outer substantially cylindrical skirt of each distal carbon fiber shell of the adjacent baffle with the exception of the baffle adjacent the distal end of the sound suppressor.

5. The sound suppressor of claim 1 wherein at least one exhaust gas notch is formed in the proximal periphery or tip of each said frustrum conical member of said proximal metal gas diffuser to allow exhaust gas to escape into a corresponding gas expansion chamber as the exhaust gas migrates through an interrupted exhaust gas channel cooperatively formed by the funnel-shaped passageways of the axially aligned baffles.

6. The sound suppressor of claim 1 wherein at least one securing notch or indentation is formed in said retainer or disk to prevent rotation of each distal carbon fiber shell relative to said corresponding proximal metal gas diffuser when said inner or proximal periphery of said inner hollow truncated cone of said distal carbon fiber shell is embedded in said annular groove of said corresponding proximal metal gas diffuser.

7. The sound suppressor of claim 1 wherein the distance or linear dimension from the distal periphery or base of the outer substantially cylindrical skirt of each distal carbon fiber shell to said distal periphery or base of the corresponding said hollow truncated cone measured along a center line axis of the sound suppressor is less than the distance or linear dimension from said distal periphery base of the inner said hollow truncated cone to the said proximal periphery or tip of the frustrum conical member of said proximal metal gas diffuser forming an annular space or passage between said proximal end portion of each said frustrum conical member of proximal metal gas diffuser and said inner truncated cone of said adjacent distal carbon fiber shell upon to said corresponding exhaust gas chamber, a gap is formed between said funnel-shaped passageways of adjacent proximal metal gas diffusers to form said interrupted exhaust gas channel.

8. The sound suppressor of claim 1 that with the exception of the proximal baffle adjacent the proximal entry of outer sheath said distal exit orifice of the frustrum conical member of each proximal metal gas diffuser is disposed adjacent and in spaced relationship relative to said inner or proximal periphery of said inner truncated cone of the next adjacent distal carbon fiber shell to form a gas expansion chamber between said distal carbon fiber distal shell, said proximal metal frustrum conical member and said inner hollow truncated cone.

9. The sound suppressor of claim 1 wherein the diameter of said distal exit orifice of said frustrum conical member is substantially equal to or greater than said diameter of said proximal metal frustrum conical member such that each said proximal metal frustrum conical member shields or shrouds a corresponding inner hollow truncated cone by deflecting solid particles suspended in the exhaust gas flowing through said distal exit orifice from the adjacent upstream metal proximal frustrum conical member of said proximal metal gas diffuser.

* * * * *